US005426964A

United States Patent [19]

Sieger

[11] Patent Number: 5,426,964

[45] Date of Patent: Jun. 27, 1995

[54] METHOD & APPARATUS FOR SHAPING A SHEET BLANK

[75] Inventor: Erich Sieger, Friedrichshafen, Germany

[73] Assignee: Zeppelin-Metallwerke GmbH, Friedrichsgafen, Germany

[21] Appl. No.: 136,335

[22] Filed: Oct. 13, 1993

[30] Foreign Application Priority Data

Oct. 19, 1992 [EP] European Pat. Off. ..... 92117831

[51] Int. Cl.[6] ..... B21D 22/18

[52] U.S. Cl. ..... 72/81; 72/84

[58] Field of Search ..... 72/80, 81, 82, 84, 86, 72/87

[56] References Cited

U.S. PATENT DOCUMENTS

| | | | |
|---|---|---|---|
| 3,248,918 | 5/1966 | Brown | 72/81 |
| 3,342,051 | 9/1967 | Leszak . | |
| 3,783,665 | 1/1974 | Ashizawa | 72/81 |
| 3,815,395 | 6/1974 | Sass . | |
| 4,134,284 | 1/1979 | Nitschke | 72/86 |

FOREIGN PATENT DOCUMENTS

| | | |
|---|---|---|
| 0457358A2 | 5/1990 | European Pat. Off. . |
| 1527973 | 9/1969 | Germany . |

*Primary Examiner*—Lowell A. larson

*Attorney, Agent, or Firm*—Armstrong, Westerman, Hattori, McLeland & Naughton

[57] ABSTRACT

A method and an apparatus for cold-forming a sheet blank (2') made of a material with an exponential stress-strain behavior to become a thin-walled, hollow shell (2). The sheet blank (2') is clamped in a clamping means (3) with its circumference and rotatingly rotated around its center line (6). The shaping takes place by a first and a second path-controlled press roll (16, 17) engaging at opposite sides of the sheet blank (2') only by local pressure forces, wherein the relative speed between the workpiece (2', 2) and the press rolls and the force exerted by the press rolls to the workpiece are modulated in a manner that the tensile forces applied to the workpiece are below the yield point of the material.

8 Claims, 2 Drawing Sheets

METHOD & APPARATUS FOR SHAPING A SHEET BLANK

BACKGROUND

1. Field of the Invention

The present invention relates to a method for shaping a sheet blank made of a material having an exponential stress-strain behavior and to an apparatus suitable for performing this method.

2. Description of Related Art

In the space and aircraft industry, titanium and its alloys are used more and more for fuel containers and the like due to the low weight and the good wear resistance. The titanium-$\beta$-alloys especially suitable for this purpose however may be cold-formed unsatisfactorily only. These alloys have an exponential stress-strain behavior, as illustrated in the schematical stress-strain diagram in FIG. 1. The diagram shows that the titanium-$\beta$-alloys do not have the usual strain hardening behavior, so that during the tensile test at room temperature above the apparent yield point, in the range of plastic deformation, an indentation and then the rupture takes place without a further increase of the stress. This has a great effect on the cold-formability of these materials. At a very low percental cold forming the danger may occur that either fatigue ruptures occur or that the material dents in an uncontrolled manner in case the material is not subjected to a heat treatment after every minor shaping step. The most unproblematic cold forming method is the cold rolling process, by means of which only planar sheets may be manufactured.

In particular shells with a greater diameter (more than 60 mm), a small wall thickness (below 3 mm) and/or a high bulging (semi-sphere) have been manufactured up to now by hot shaping methods, wherein afterwards the desired wall thickness had to be achieved by machining.

At higher temperatures, titanium and its alloys have a higher affinity towards air components, by which on one hand a corrosion layer forms at the surface of the workpiece and by which on the other hand the material becomes brittle by hydrogen absorption. Both are highly undesired and can only be avoided or eliminated if either the heating up (for hot shaping or for the heat treatment) is carried out in a protective gas atmosphere or if the corroded layer is removed mechanically or if the brittleness is eliminated by heat treatment). It is already known from U.S. Pat. No. 3,815,395 to form tank bottoms by means of two spinning rolls engaging opposite sides of the workpiece. In the apparatus described in this U.S. Patent, the workpiece is clamped centrally and supported freely movably, whereas the spinning rolls are rotationally driven and are also guided via a predetermined, radial path (by means of which the workpiece rotates). By means of this superposition of the movement control, it cannot be avoided that local tensile stresses appear. According thereto, the apparatus is either suitable for a hot-forming process of for workpieces with a normal cold hardening behavior.

It is the object of the invention to provide a simple and inexpensive method and an apparatus for cold forming a material with an exponential stress-strain behavior to form hollow shells of a small wall thickness.

SUMMARY OF THE INVENTION

It has been noted that the above mentioned failures, as for example fatigue ruptures or indentations will not occur when cold forming these materials according to the invention also at high shaping degrees of more than 40%, if the material is not subjected to any tensile forces in the plastic range and the shaping is only carried out by pressure forces which are exerted to the workpiece by the two opposite pressing rolls. By the method according to the invention it is possible to manufacture hollow shells by cold forming with a great diameter and a relatively thin wall thickness until the final measure without fatigue ruptures or indentations occurring and without the problems occurring during heating the material. The high cold forming degree obtainable by the method according to the invention results in the grains becoming more fine in the structure oft he titanium-$\beta$-alloy, which in turn results in a higher strength and toughness, so that the bearing cross-section and thus the weight may further be reduced. Moreover, the high cold forming degree leads in circumferential direction to a change of the texture of the original rolling direction of the cold-rolled sheet blank, so that the danger connected with this texture of an intrinsic tensile draft is reduced. The pressure forces to be exerted via the press rolls may be dosed very precisely, so that not only shells with a constant wall thickness but also wall thicknesses which are changing over the circumference of the shell are easily manufacturable. Moreover, the resilience occurring when bulging the sheets may be controlled by using two rolls, so that the shells may be manufactured with a very high accuracy. Since neither a protective gas atmosphere nor repeated intermediate annealings are necessary, the method according to the invention may be carried out simply and easily.

The workpiece is rotationally driven and the press rolls are driven path-controlled in the apparatus according to the invention. This separation of the relative movement contributes to preventing tensile stresses in the plastic range during the shaping process.

BRIEF DESCRIPTION OF THE DRAWINGS

An embodiment of the invention will now be described with reference to the accompanying drawings.

DESCRIPTION OF PREFERRED EMBODIMENTS

Figure 1:
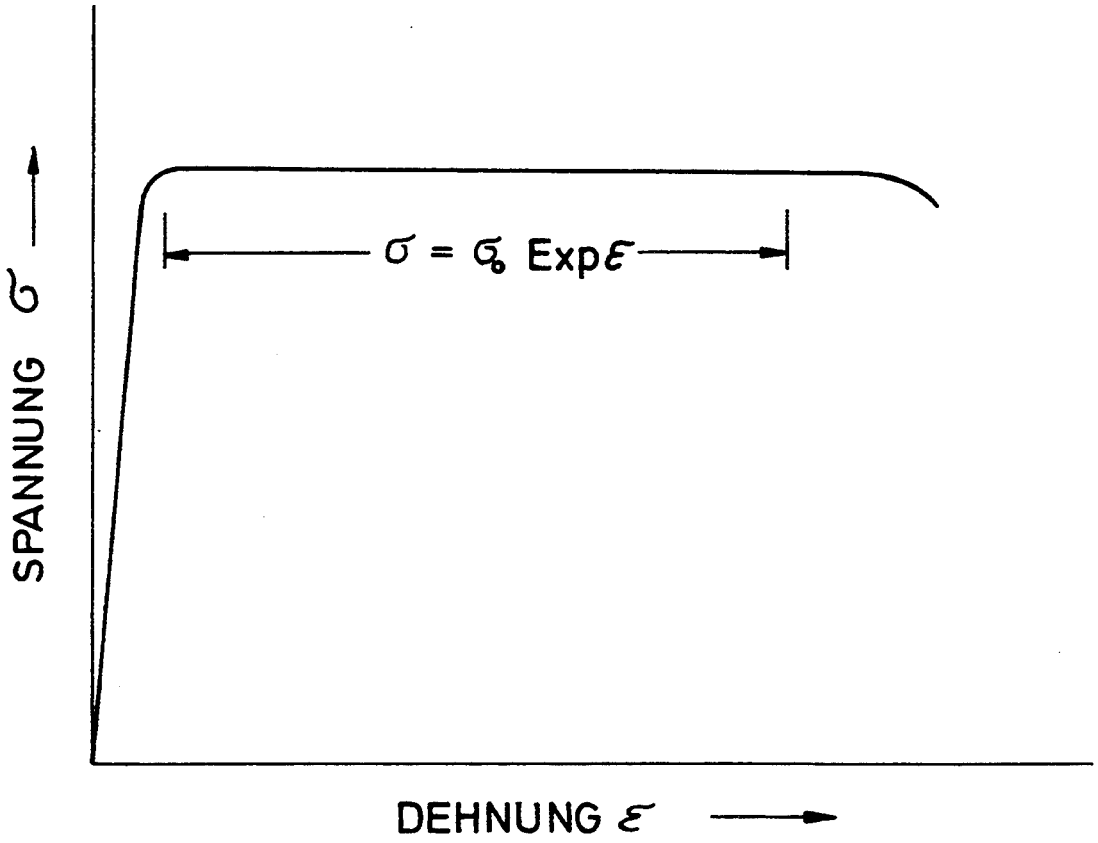
FIG. 1 is a true, schematical stress-strain diagram of a titanium-$\beta$-alloy.
Figure 2:
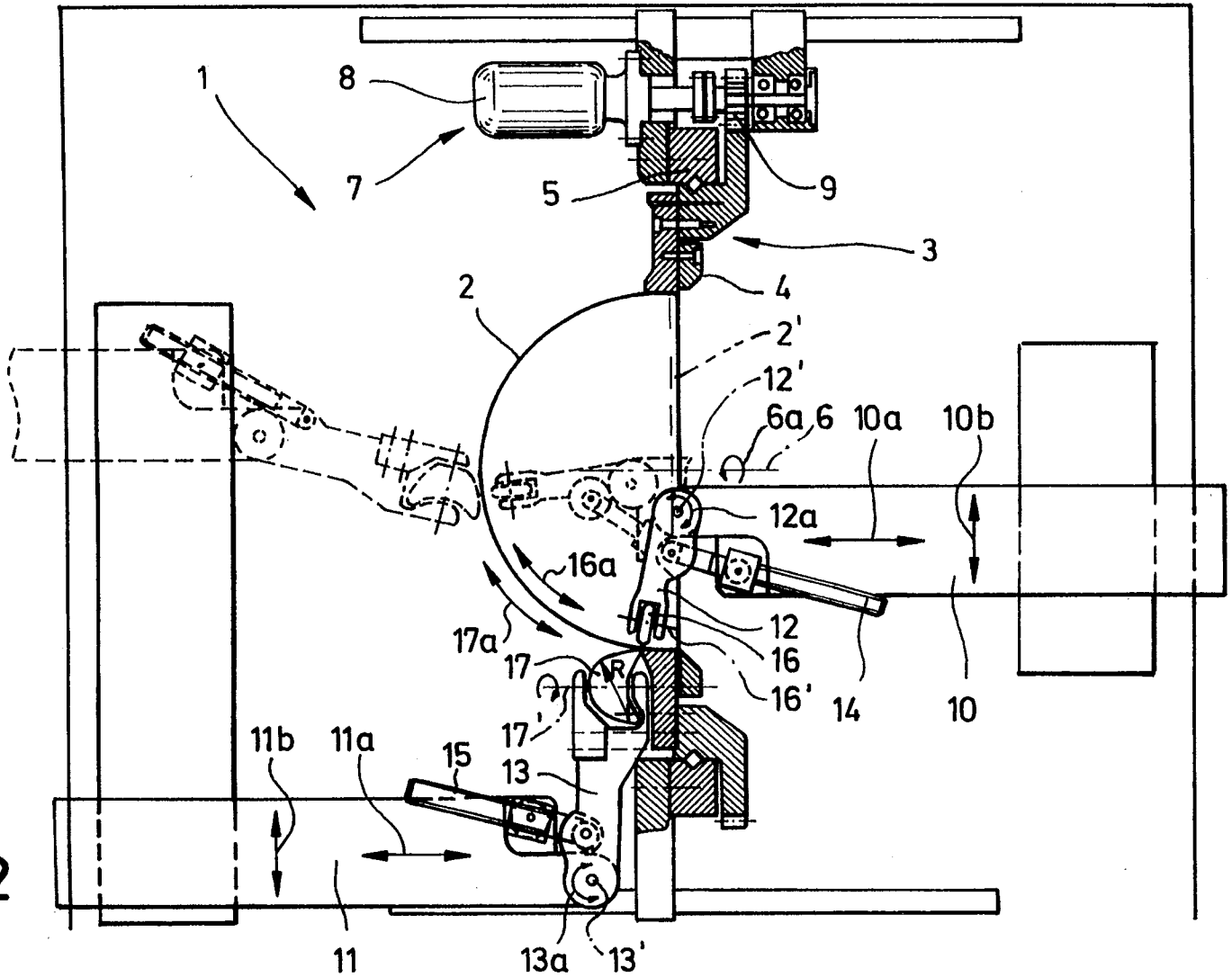
FIG. 2 is a schematical view of a section of the apparatus according to the invention.

FIG. 2 shows an apparatus 1 for cold forming sheet blanks 2' (shown in dotted lines) to become hollow shells 2 which may be formed besides the drawn semi-sphere also spherical-cap-shaped, conical, elliptical or which may have any other cross-section. The sheet blank 2' is present as a circular sheet blank made of a material with the exponential stress-strain characteristic shown in FIG. 1. The titanium-$\beta$-alloys Ti—15V—3-Cr—3Al—3Sn(Ti15-3) and Ti—3Al—15Mo—2, 7Nb—0, 2Si(Beta-21S) belong to these materials. The sheet thickness of the blank 2' normally is thicker than the desired sheet thickness of the ready shell, it may however already have its final size at certain regions (close to the opening, pole). In case the ready shell 2 should comprise greater wall thickness differences, it may be useful to contour the sheet blank with different raw wall thicknesses in advance, e.g. by turning or grinding. The diameter of the sheet blank 2' is chosen corresponding to the desired opening width of the ready shell plus the clamping size. With the present method, shells with an opening width of more than 600 mm may be manufactured, which haven't been manufacturable by cold forming until now. Even openings widths of 1500 or 2500 mm and more are also possible. The method according to the invention is in particular applied for thin-walled shells with a wall thickness of between 0.3 and 3 mm.

The sheet blank 2' is held in the apparatus 1 by a clamping means 3, which comprises a clamping ring 4 for evenly clamping the periphery of the sheet blank. The clamping device may be adjustable, to enable a clamping of blanks 2' having different diameters. The clamping ring 4 is rotatably supported via a rotating bearing 5 formed as a rolling bearing about a center line 6 in the direction towards the arrow 6*a*. The rotation is effected by a drive 7, comprising a motor 8 and a drive pinion 9, which meshes with a respective gearing at the clamping ring 4.

One tool carrier 10 and 11 each is located at both sides of the clamping device 3. Each of the tool carriers 10, 11 is linearly displaceable in a first direction in the direction of the double arrows 10*a* and 11*a*, respectively parallel to the center line 6, and in a second direction in the direction of the double arrows 10*b* and 11*b*, respectively vertical to the center line 6. The moving direction 10*a* and 10*b* and 11*a* and 11*b*, respectively, are located on a single level. At the end of each tool carrier 10, 11 facing the clamping means 6 one arm 12 and 13 each, is rotatable about an axis 12' and 13' in the direction of the double arrows 12*a* and 13*a*, respectively. The axes 12' and 13' respectively are standing vertical on the moving level of the linear displacements 10*a*, 10*b* and 11*a*, 11*b*, respectively, so that the torsional movement 12*a*, 13*a* takes place in the level of the linear movements 10*a*, 10*b* and 11*a*, 11*b*, respectively. For pivoting the arms 12 and 13 in the direction of the double arrows 12*a*, 13*a*, a suitable setting drive 14 and 15, respectively is provided, which at the same time exerts the shaping power. A drive—not shown—is provided for also displacing each tool carrier 10, 11 in the direction of the double arrows 10*a* and 11*a*, 11*b*, respectively.

One spinning or press roll 16, 17 is freely rotatably supported at the free end of each arm 12, 13 about an axis 16' and 17' respectively. The axes 16' and 17' respectively extend vertical to the pivot axis 12' and 13' respectively, of the respective arm 12, 13 and are arranged in a manner that each press roll 16, 17 projects with its circumference over the respective arm 12, 13 and that the projecting portion of its circumference may be brought in contact with the workpiece 2', 2 The press rolls 16, 17 are moreover disposed in the direction of the rotation of the workpiece 2', 2, so that they may be rotated by the rotating workpiece about their axes 16', 17'.

The first press roll 16 engaging at the inner surface of the bulging to be manufactured is relatively narrow and is provided with a blanked-off circumference, so that when the bulgings are very narrow, only the circumference of the first press roll 16 comes in contact with the workpiece 2', 2. The second press roll 17 disposed at the outer side of the bulging to be manufactured is formed as a counter-roll, against which the first press roll 16 is acting.

The drive of the clamping device 3, the setting drives 14 and 15 as well as the—not shown—drives for moving the tool carriers 10, 11 in the directions 10*a*, 10*b* and 11*a*, 11*b*, respectively, are connected with a common control means, which is also not shown. The control means may be a computerized numerical control means, a copying control means with templates or any other known control means. The press rolls 16 and 17 are synchronously guided during the shaping process by this control means, so that at the place of the shaping both press rolls 16, 17 are always working against one another. Both press rolls 16, 17 are controlled by a combined linear movement along the double arrows 10*a*, 10*b* and 11*a*, 11*b*, respectively and a pivot movement along the double arrows 12*a*, 13*a* in the direction of their axes 16', 17' over a path along the double arrows 16*a*, and 17*a*, which follows the contour of the bulging formed by this shaping step. The paths 16*a* and 17*a*, respectively of the press rolls 16 and 17, respectively, extend radially to the sheet blank 2' and over a meridian of the bulging, wherein the common level on which the paths 16*a* and 17*a* are located, intersects the center line 6. The direction of the shaping takes place from the range close to the clamping ring 4 to the piercing point of the center line 6 through the workpiece 2', 2 at the pole and backwards, wherein the rolls 16, 17 in the position drawn in full lines in FIG. 2 are located close to a reversing point of the path control means and, drawn in dotted lines, close to the other reversing point of the path control means. The path control means is carried out in a manner that both press rolls 16, 17 may only pivot in their position relative to one another about the center of the bend of their circumferential surfaces (radius R) in order not to generate any friction.

Moreover, the control means effects a feed movement of the press roll 16 in the direction towards the counter roll 17 and away from it, to adjust the distance between the two press rolls 16 and 17 to the wall thicknesses of the workpiece 2', 2 which are reducing in the course of the shaping process. This feed movement may be carried out during the shaping process and may for example be controlled by pressure sensors at the press rolls. Moreover, a control means determined in advance of the roll distance is also possible, if regions of the workpiece 2', 2 are to be formed differently strong, e.g. to provide the shells 2 with different wall thicknesses.

The apparatus 1 according to the invention works as follows: After clamping the sheet blank 2', the clamping ring 4 is rotated by the drive 7 about the center line 6 in the direction towards the arrow 6*a*. Then, the press rolls 16 and 17 are approached to the blank at a certain distance to each other from opposite sides and are guided over the blank radially to the blank 2' in a path 16*a* and 17*a*, respectively predetermined for the first shaping step, so that in connection with the rotation of the blank 2' a spiral-shaped shaping line extending about the center line 6 results. The number of revolutions of the clamping ring 4, the distance of the press rolls 16, 17 as well as the shape and speed of the path control means in the direction of the arrows 16*a* and 17*a* are modulated to one another and to the material used, that by means of the press rolls 16 and 17 only pressure forces for shaping the material are exerted, whereas tensile forces eventually occurring remain below the yield point of the material and thus do not contribute to the plastic shaping process. Thus, the material is only squeezed between the press rolls 16 and 17, wherein the material is enabled to lengthen essentially vertical to the direction of the pressure forces. By means of the path control means of the press rolls 16, 17 it is ensured, that this lengthening of the material does not lead to denting but forms the desired bulging without the material having to be strained by tensile stresses, as is the case in conventional spin forming methods.

A tank semi-shell has e.g. to be shaped from the titanium alloy Ti 15-3 by the method according to the invention. A circular sheet blank having a diameter of 510 mm has been used that has been cut from a cold rolled sheet by a cutting roll machine in solution heat treated and quenched condition, sheet thickness 2.08 mm. The sheet blank has been shaped by means of two press rolls only by use of pressure forces in 28 shaping steps without any intermediate annealing to a semi-spherical shell with an opening diameter of 444.8 mm, an unchanged wall thickness of 2.08 mm directly at the pole, a wall thickness of 2 mm in angular distance of approx. 5° to the pole, a wall thickness of 1.32 mm directly adjacent the clamping position at the shell opening and a wall thickness course continuously decreasing between the shell opening and the pole to approx. 0.76 mm and finally continuously increasing again. Neither fatigue ruptures nor discontinuities of the shape such as wrinkles or dents have been found in the ready tank semi-shell. The deviations in size to the predetermined shape and wall thickness (smallest obtained wall thickness 076; allowed thickness 0.8 mm; obtained opening diameter 444.8 mm, allowed thickness 445 mm) were within the tolerance. These deviations in size resulted due to the fact that in the used apparatus, the press rolls 16, 17 are not pivotable, i.e. not supported with the axes 12*a*, 13*a* at the tool carrier 10, 11. Moreover, the press roll 16 engaging at the inner side of the shell has been path controlled by an inductive copying means according to a copying template and the counter roll 17 has been path controlled manually via hydraulic valves.

Moreover, a tank semi-shell with an opening diameter of 950 mm has been manufactured. A pre-contoured circular sheet blank serves as starting material,the sheet thickness of which being close to its center point 3.2 mm, the remaining outer rim section is 2.1 mm. The transition between the two wall thickness regions was blanked off. The contouring was carried out by grinding or turning methods especially developed for titanium alloys. The pre-contoured circular sheet blank has been cold formed without any intermediate annealing step to a tank semi-shell with an opening diameter of 950 mm according to the method of the invention. The material has also been shaped in the pole section of the shell and thus lengthened, so that the wall thickness in the pole was reduced to 3.0 mm. The wall thickness in the opening region of the shell was 1.2 mm. Between the shell opening and the pole, the wall thickness was reduced to 0.8 mm and then raised again continuously. The leap in thickness of the pre-contoured sheet blank was always balanced out, but it was still visible. This tank semi-shell also did not have any fatigue cracks or shape discontinuities, such as wrinkles or dents after the shaping process.

By means of a suitable path control means of the press rolls, also shells with an almost constant wall thickness may be manufactured besides the described shells having the continuously changing wall thicknesses.

As a modification of the described and drawn embodiment, the press rolls may also be moved only on two axes linearly, as already mentioned, if greater manufacturing tolerances are allowed. The shape and size of the press rolls may be changed according to the shaping work to be carried out. Both press rolls may have the same shape. Under certain circumstances, an already pre-shaped blank may also be used instead of the circular sheet blank.

I claim:

1. A method for shaping a flat sheet blank of a metal having an exponential stress-strain behavior to the form of a hollow shell having a wall thickness from about 0.3 mm to about 3 mm comprising clamping the sheet blank, rotatingly driving the clamped sheet blank about a centerline extending through a centerpoint of the sheet blank and perpendicular to a plane of the sheet blank, engaging opposite sides of the rotating sheet blank with a pair of pressing rollers opposed to each other, cold-forming the sheet blank to the form of a hollow shell by moving the opposed pressing rollers between the periphery of the rotating sheet blank and the centerpoint thereof in a controlled path defining the shape of the hollow shell so as to squeeze the metal between the pressing rollers whereby the metal is enabled to lengthen in a direction essentially vertical to the direction of pressure forces applied by the pressing rollers without applying tensile forces above the yield point of the metal, and controlling the path of movement of the pressing rollers linearly in a first direction paralled to the centerline of the sheet blank and in a second direction normal to the first direction, the first and second directions lying in a common plane, and by rotating at least one of the pressing rollers about an axis extending perpendicular to the common plane of the first and second directions of linear movement.

2. A method according to claim 1, further comprising, during shaping of the sheet blank, linearly and rotatively moving the pressing rollers in a circular path from the periphery of the sheet blank to the center line thereof and backwards in a plane extending essentially through the plane of the centerline of the sheet blank.

3. A method according to claim 1, wherein the press rolls are freely rotatable about their respective roll axes.

4. Apparatus for shaping a sheet blank of a metal with an exponential stress-strain behaviour to a hollow shell having a wall thickness from about 0.3 to about 3 mm, comprising a clamping means for clamping a section of a circular sheet blank, drive means for rotatingly driving the clamping means around a centerline extending through the center of the sheet blank and vertically to the plane of the surface thereof, a first, path-controlled, press roll disposed on one side of the clamping means, a second, path-controlled, press roll disposed on the other side of the clamping means opposite the first press roll, and means to control the movement path of the press rolls linearly in a first direction parallel to the centerline of the sheet blank and in a second direction normal to the first direction, the first and second directions lying in a common plane, and to rotate at least one of the press rolls in a third direction about an axis lying in a plane parallel to the plane of the centerline and extending perpendicular with respect to the common plane of the first and second directions of the linear movements.

5. Apparatus according to claim 4, wherein each of the press rolls is disposed on an arm rotatable in said third direction and mounted on a tool carrier which is linearly displaceable in directions parallel and normal to the centerline and at right angles to one another.

6. Apparatus according to claim 5, wherein the press rolls are freely rotatable on the arm about a roll axis extending at a right angle to a rotational axis of the arm.

7. Apparatus according to one of claims 4 to 6, wherein the control means is a computerized numerical control.

8. Apparatus according to one of claims 4 to 6, wherein the control means includes a copying control with templates.

* * * * *